United States Patent [19]

Ogura

[11] Patent Number: 4,838,717

[45] Date of Patent: Jun. 13, 1989

[54] SERIAL DOT MATRIX PRINTER

[75] Inventor: Wataru Ogura, Nagano, Japan

[73] Assignee: Chinon Kabushiki Kaisha, Nagano, Japan

[21] Appl. No.: 149,489

[22] Filed: Jan. 28, 1988

[30] Foreign Application Priority Data

Jan. 28, 1987 [JP] Japan ..... 62-17967

[51] Int. Cl.[4] ..... B41J 19/30; B41J 29/20

[52] U.S. Cl. ..... 400/322; 250/237 G; 400/705.1

[58] Field of Search ..... 400/320, 322, 323, 328, 400/705.1; 250/237 G

[56] References Cited

U.S. PATENT DOCUMENTS

| | | | |
|---|---|---|---|
| 4,119,383 | 10/1978 | Watanabe | 400/320 X |
| 4,180,704 | 12/1979 | Pettit | 400/705.1 X |
| 4,247,214 | 1/1981 | Swan | 400/705.1 |
| 4,507,647 | 3/1985 | Minami | 250/237 G X |
| 4,602,242 | 7/1986 | Kimura | 250/237 G X |
| 4,654,527 | 3/1987 | Schmitt | 250/237 G |
| 4,667,099 | 5/1987 | Arai | 250/237 G X |

OTHER PUBLICATIONS

IBM Tech. Disc. Bulletin, by K. H. Burkardt, vol. 23, No. 11, Apr. 1981, p. 4984.

*Primary Examiner*—Paul T. Sewell

*Attorney, Agent, or Firm*—Birch, Stewart, Kolasch & Birch

[57] ABSTRACT

A serial dot matrix printer is provided with a slit encoder and an optical sensor opposed to the slit encoder. In the slit encoder, firing signal slits each having a fixed width are provided at a fixed pitch, and block signal slits each having a width smaller than that of each firing signal slit are provided in every block composed of a plurality of the firing signal slits. As a carriage moves, the optical sensor moves along the slit encoder to produce a signal at every slit. The signal from the optical sensor is applied to a first control device having a block detector and a firing timing unit. The block detector receives the signal from the optical sensor, measures the passing time between every slit, and detects a block signal according to a difference in passing time between the slits. The firing timing unit produces firing timing signals obtained by equally dividing the passing time of each of the firing signal slits by a predetermined number whenever the passing time of the each firing signal slit is measured. There is further provided a second control device having a carriage controller for controlling a carriage moving motor according to the block signal.

7 Claims, 4 Drawing Sheets

SERIAL DOT MATRIX PRINTER

BACKGROUND OF THE INVENTION

1. Field of the Invention

The present invention relates to a serial dot matrix printer and particularly relates to a serial dot matrix printer for carrying out a printing operation with a printing head mounted thereon while a carriage having the printing head is shuttled between respective ends of a printing medium.

2. Description of the Prior Art

Generally, a dot printer requires that mechanisms be moved at a high speed and positioning be performed accurately. To this end, a method has been employed in which a slit encoder and a photo sensor (hereinafter referred to as a photo encoder in combination) are associated with a carriage moving mechanism so that the stroke of movement of a carriage is controlled/divided and the dot timing is adjusted to suppress the displacement of dots between the forward and backward movements of the carriage. The method is used in a printer of the shuttle type in which a carriage is always moved right and left with a fixed stroke.

That is, in the printer of the shuttle type, the number of dots in a stroke can be made small so that photo encoder functions equal in number to the dots can be provided on a mechanism portion, such as a cam or the like, which is associated with the movement of the carriage and in which the actual distance of movement of the carriage is mechanically enlarged. Further, an inexpensive photo sensor may be used as the photo encoder.

On the other hand, in a serial dot matrix printer (hereinafter referred to a serial printer), the movement of a carriage is controlled on the basis of the number of steps of a stepping motor so that a dot command is applied to a printing head at positions determined by time-dividing the length of each step. For example, if a step has a length of 0.28 mm, the length is divided into four, as a result of which a dot interval is made to be 0.07 mm.

This is because the stroke in the serial printer is several times longer than that in the printer of the shuttle type, and the carriage is operated to return back from a given position.

In that case, as the carriage moving mechanism, it is necessary to use a motor which can be driven by very fast clocks so that the motor can follow the period of dots of the printing head (that is, a period in which outputs can be continuously provided).

If a photo encoder is used also in the serial printer similar to the printer of the shuttle type so that the photo encoder is associated with the carriage per se to thereby control the position of movement of the head actually moved by the carriage, displacement of dots can be suppressed as a result of which the printing speed can be made higher. An experiment performed by the inventor of this application has proved that if the absolute position of the carriage is continuously detected/-controlled with a pitch smaller than about 0.7 mm, the printing operation can be performed with regular dot intervals of 0.07 mm at a speed of one dot per msec even if variations are generated in the moving speed of the carriage to an extent.

The continuous detection and control of the absolute position of the carriage with a pitch smaller than about 0.7 mm can be satisfied by use of a photo encoder substantially equal in manufacturing cost as well as in accuracy to that used in the printer of the shuttle type.

However, if such a photo encoder as described above is used as it is in the serial printer, the following problems will be caused.

That is, the serial printer operates to return the carriage from a given position as described above, and therefore the serial printer exhibits a displacement from vibration of 0.3 mm or about 2 mm depending on a machine, is repeated when the carriage stops to perform a return. Accordingly, even if the printer is the best machine (0.3 mm), photo slits formed at intervals smaller than about 0.7 mm may be counted a plural number of times, so that the absolute position of the carriage is inaccurately determined. Therefore, displacement of dots is caused between forward and backward movement of the carriage. Accordingly, the method using a photo encoder can not be employed in print with high quality such as graphic printing or the like, and therefore the method has been used with the printing speed lowered and in unidirectional printing.

SUMMARY OF THE INVENTION

It is therefore an object of the present invention to eliminate the problems in the prior art.

It is another object of the present invention to provide a serial dot matrix printer in which a photo encoder is used facilitate the control of the distance of movement of a carriage and to enable printing to be carried out with no displacement of dots and with high quality.

In order to attain the above objects, the serial dot matrix printer according to the present invention is arranged as follows. The serial printer is provided with a slit encoder and an optical sensor opposed to the slit encoder. In the slit encoder, firing signal slits each having a fixed width are provided at a fixed interval, and block signal slits each having a width smaller than that of each firing signal slit are provided in every block composed of a plurality of firing signal slits. As a carriage moves, the optical sensor moves along the slit encoder so as to produce a signal at every slit. The signal produced from the optical sensor is applied to a first control device having block detecting means and firing timing means. The block detecting means receives the signals produced from the optical sensor, measures the time period between every slit, and detects a block signal from the block signal slits on the basis of a difference in a time period between successive slits. The firing time means produces firing timing signals obtained by equally dividing the time interval of each of the firing signal slits every time the time interval of each firing signal slit is measured. There is further provided a second control device which has carriage control means for controlling a carriage moving motor in response to the block signal.

According to the present invention, the block signal generated at every block is detected, and the movement of the carriage is controlled on the basis of the detected block signal, so that the absolute position of the carriage is never inaccurate even if the carriage vibrates when it is stopped and therefore printing can be made correctly without causing any dot displacement. Further, the firing timing means produces the firing timing signals by equally dividing the time period between the preceding firing signal slit on the basis of the measured time interval, so that even if variations are caused in carriage speed, the carriage is not influenced by the variations so that no displacement is caused in printing.

DETAILED DESCRIPTION OF PREFERRED EMBODIMENT

Figure 1:
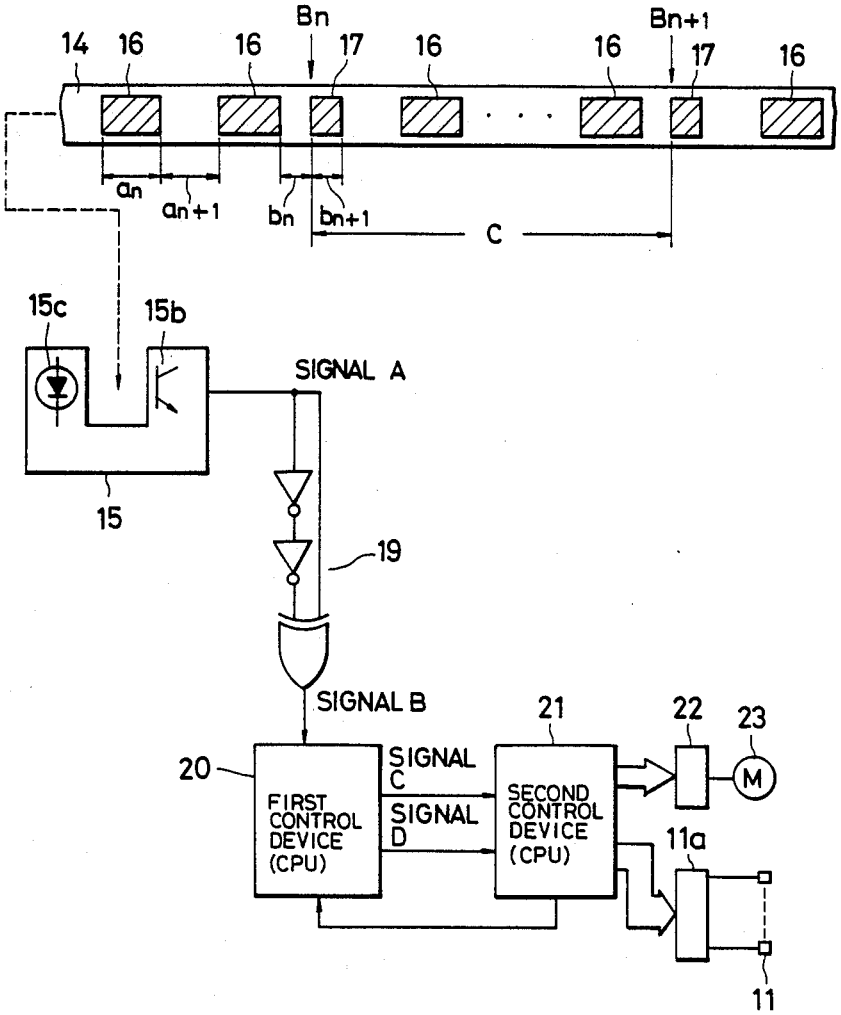
FIG. 1 is a view showing the construction of the main portion of an embodiment of the serial dot matrix printer according to the present invention.

Referring to the drawings, an embodiment of the present invention will be described hereunder.

Figure 2:
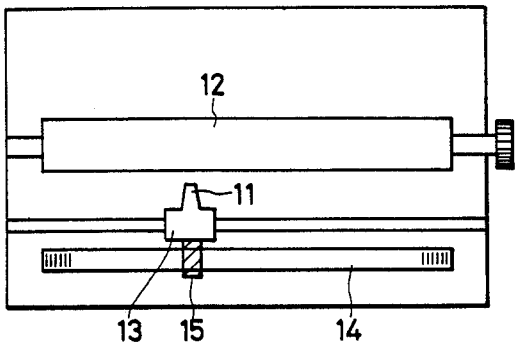
FIG. 2 is a plan view showing the schematic construction of the serial dot matrix printer.
Figure 3:
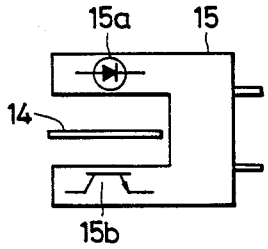
FIG. 3 is a view showing the relationship between an optical sensor and a slit encoder shown in FIG. 2.

First, referring to FIG. 2, a general arrangement of the serial dot matrix printer will be described. In the drawing, a printing head 11 is disposed in opposition to a platen 12 and attached to a carriage 13 so as to be able to shuttle along the longitudinal direction of the platen 12. A slit encoder 14 is made of a plate material in which slits are formed with a predetermined pitch as will be described in detail later. The slit encoder 14 is provided along the moving direction of the carriage 13 and is in opposition to an optical sensor 15 provided on the carriage 13 as shown in FIG. 3.

Figure 4:
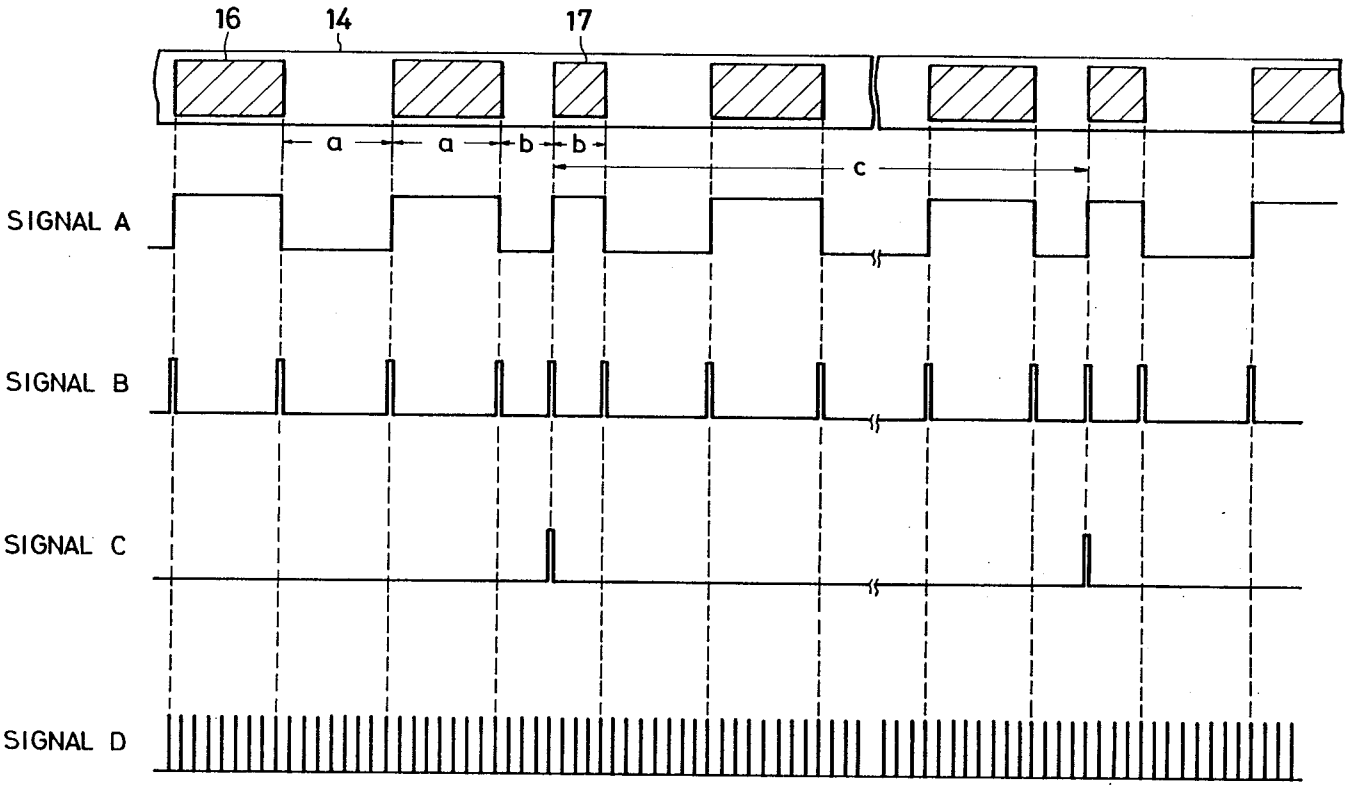
FIG. 4 is a timing chart for explaining the relationship between the slit encoder shown in FIG. 1 and signals corresponding to the slit encoder.

Next, referring to FIG. 1, a main portion of the embodiment will be described in detail. Firing signal slits 16 are successively formed in the slit encoder 14 with a space between slits equal to a width a of each slit as shown in FIG. 4. A block signal slit 17 having a width shorter (about a half) than that of each of the firing signal slits 16 is formed periodically between a plurality of the firing signal slits 16 with a space between slits 16 and 17 equal to a width b of the block signal slit 17. The length of slits extending over a pitch c between successive block signal slits 17 is called a block. That is, the pitch c represents the length of each block.

In the case where the present invention is applied to a printer having resolution of 1/360" (about 70 μm), the width a of each firing signal slit 16, the width b of each block signal slit 17, and the length c of each block are selected, for example, as follows. $a=1/45'' \simeq 0.56$ mm, $b=1/90'' \simeq 0.28$ mm, $c=5.1$ mm.

The width b of each block signal slit 17 is selected to be a minimum value which can be sufficiently detected by the optical sensor 15 even if the optical sensor is a relatively inexpensive one. The minimum width which can be detected by an inexpensive optical sensor is 0.25 mm, and therefore the above-mentioned slit width b of 0.28 mm is sufficient for such an inexpensive optical sensor. The width a of the firing signal slit is twice as large as the slit width b. The slit width a is preferably selected to be a maximum of ten times as large as the resolution pitch. In the embodiment, the resolution is 70 μm as described above, and therefore the slit width a of 0.56 mm is less than ten times the resolution of 70 μm. The length c of the block is set to 4 mm or more which is a length capable of sufficiently absorbing vibrations when the carriage 13 is stopped. However, if the length c of the block is too long, the carriage 13 is caused to move needlessly long, so that the stop position of the carriage 13 is limited to thereby lower the throughput (actual printing speed) of the printer. The length c of the block in the present embodiment is set to 5.1 mm as described above, and therefore the vibrations when the carriage 13 is stopped can be sufficiently absorbed and the throughput mentioned above is not adversely.

The optical sensor 15 is provided with a light emitting diode **15*a* and a photo transistor 15*b* opposed to each other so as to interpose the slit encoder 14 therebetween as shown in FIG. 3. As the carriage 13 is moved, the output of the optical sensor 15 is inverted every time the optical sensor passes by each of the slits 16 and 17 provided in the slit encoder 14. That is, a signal A as show in FIG. 4 is produced from the optical sensor 15. The signal A is applied to a differentiation circuit 19 and differentiated so that a signal B as shown in FIG. 4 is produced. The signal B is applied to a first control device 20** using a CPU.

Differentiation is used to perform high speed signal processing by using interruption (external interruption) for the CPU constituting the first control device 20.

The first control device 20 is provided with block detecting means for producing a block C as shown in FIG. 4 and firing timing means for producing a firing timing signal D as shown in FIG. 4 on the basis of the signal B. Both signals C and D are input to a second control device 21.

Figure 6:
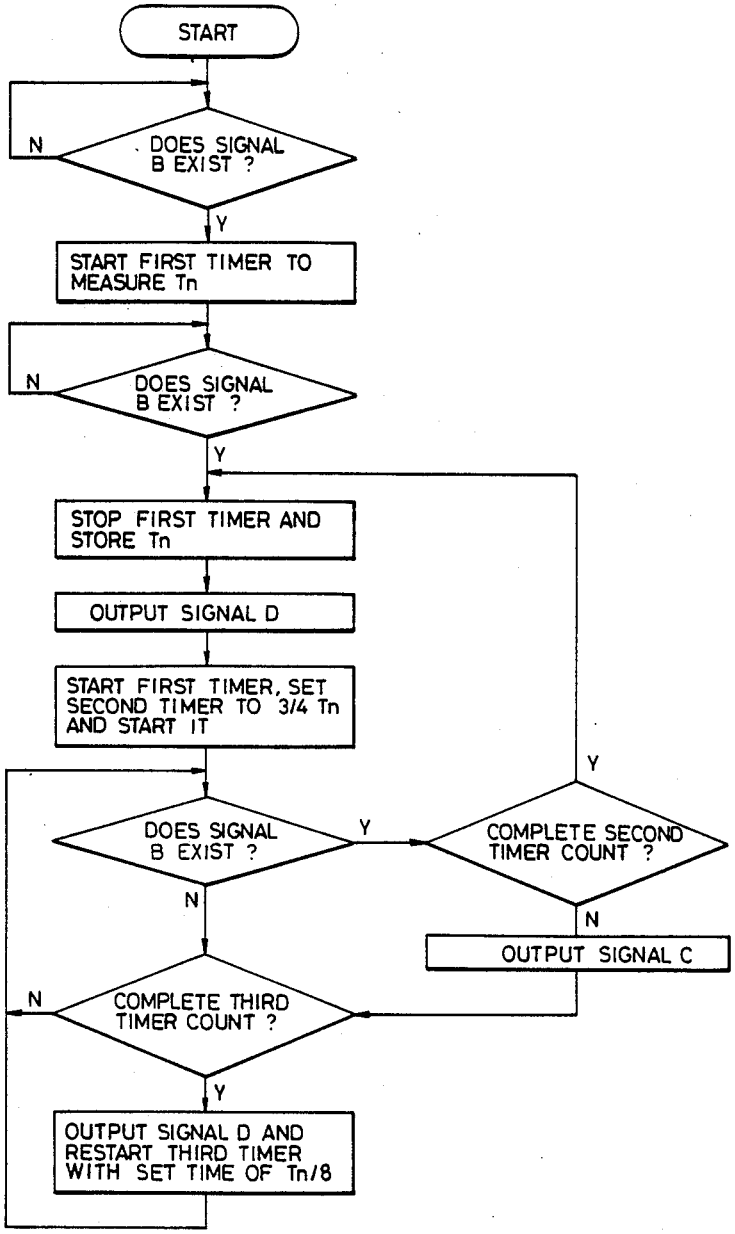
FIG. 6 is a flowchart illustrating the detection of signals B, C and D.

As shown in FIG. 6, the block detecting means is so arranged as to measure an interval of the differentiation pulse signal B, that is, the transit time through the slit width a of each of the firing signal slits 16, by using a first timer provided in the CPU. The transit time is represented by Tn. After the measurement, a second timer checks whether a succeeding differentiation pulse is applied within the time of $\frac{3}{4}$ Tn. If the carriage 13 is moved to a boundary Bn of the block in FIG. 1, a differentiation pulse is applied after the lapse of time of $\frac{1}{2}$ Tn if the transit speed of the carriage 13 is constant. That is, when the next differentiation pulse is applied within the time of $\frac{3}{4}$ Tn defined by the second timer, it is judged that the carriage 13 has reached the boundary Bn of the block and the block signal C is produced. The value of $\frac{3}{4}$ Tn which is the set time of the second timer is the value determined on the assumption that there is no sudden speed change by 30% or more. Actually, there is no speed change by 30% at all and therefore there is no problem even if the set time is made to be $\frac{2}{3}$ Tn.

Thus, the block detecting means is arranged to measure the transit time through each of the slits 16 and 17 formed in the slit encoder 14, on the basis of the differentiation pulse signal B, so as to detect the block signal C due to each block signal slit 17 on the basis of the difference in transit time between the slits 16 and 17.

The firing timing means is arranged to produce the firing time signal D for controlling the printing dot positions on the basis of the differentiation pulse signal B. That is, the firing timing means measures the interval of the differentiation pulse signal B and equally divides the transit time Tn through the slit width a of the firing signal slit 16 whenever it obtains the transit time Tn to thereby obtain the firing timing signal D. In the embodiment, since the slit width a of the firing signal slit 16 is selected to be 0.56 mm, it will do to divide the transit time Tn through the slit width a of 0.56 mm into eight equal parts in order to perform printing operation at a pitch or resolution of 0.07 mm. That is, in order to obtain the firing timing signal D, first one pulse is produced at the time when the differentiation pulse is applied. Immediately there after, a third timer incorporated in the CPU is set to operate at the one-eights time Tn/8, so that seven pulses are produced at an interval of Tn/8 by means of the third timer. Then, the operation is repeated so as to produce the signal D in FIG. 4.

Thus, the pulse interval of the firing timing signal D is determined from the pulse interval time whenever the differential pulse is applied. That is, the pulse interval used in a section $a_{n+1}$ is determined on the basis of the transit time in a section $a_n$ in FIG. 1, and therefore the printing dot position never displaces even if a change occurs in speed of the carriage 13. That is, if the carriage 13 is controlled in accordance with a constant pulse interval, the dot position displaces so that printing displaces when a change occurs in speed of the carriage 13. As described above, however, the dot position never displaces when the pulse interval at a certain time is determined on the basis of the moving speed of the carriage 13 just before that time.

The second control device 21 is used for sequence-control of the entire printer. The second control device 21 employs a CPU similar to the first control device 20, and is provided with carriage control means for controlling a carriage moving motor (stepping motor) 23 through a driver 22 and printing control means for controlling the printing head 11 through a head driver 11*a*. Further, the second control device 21 supplies a driving signal to the first control device 20.

The carriage control means is arranged to control the carriage moving motor 23 on the basis of the block signal C obtained by the first control device 20. When the carriage 13 is stopped so as to cause the carriage 13 to turn back at a given position, the carriage control means controls the carriage 13 to stop at a central position in a succeeding block having no firing signal adjacent a preceding block having a firing signal (by which printing is performed).

The method of stopping the carriage 13 at a center of a block will be described. Assume that the carriage 13 is moved by the length c of one block when the carriage moving motor 23 of the stepping motor is driven, for example, by 20 steps (20 pulses). Upon completion of a last block having printing data, the carriage control means moves the motor 23 by 10 steps after reception of a succeeding block signal C and then stops the motor 23. By the operation, the carriage 13 is stopped at the center of the block. As a result, the vibrations of the carriage 13 can be absorbed within the block even if the carriage 13 vibrates, whereby the position of the carriage 13 is never misaligned.

The printing control means is provided with printing data previously set, and firing signals have been set in blocks in which the printing data are to be printed. In a block where printing is made, that is, in a block having the firing signals, the dot position is controlled on the basis of the firing timing signal D produced by the first control device 20 so that printing is carried out by printing head 11.

Figure 5:
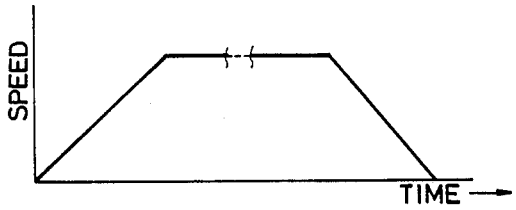
FIG. 5 is a graph showing a state where a motor is driven.

In the arrangement described above, the carriage moving motor 23 is driven by the second control device 21 so that the movement of the carriage 13 is started. In the case where a stepping motor is used as the carriage moving motor 23, the stepping motor is driven in such a manner as shown in FIG. 5 so as to make the speed high in a constant speed range.

As the carriage 13 moves, the signal A is produced from the optical sensor 15 whenever the carriage 13 passes through each of the slits 16 and 17. The signal A is differentiated by the differentiation circuit 19 so that the pulse-like signal B is produced from the differentiation circuit 19 and applied to the first control device 20. The first control device 20 has received the driving signal from the second control device 21 at the time when the carriage moving motor 23 is driven, and therefore is in an operative state. Accordingly, upon receiving the pulse signal B, the first control device 20 detects the block signal C whenever the carriage 13 passes through a block position successively from a block position nearest to the carriage 13. Further, whenever the pulse signal B is applied to the first control device 20, the first control device 20 produces the firing timing signal D having a pulse repetition period which has been determined on the basis of the speed of the carriage 13 immediately before that time. Both signals C and D are applied to the second control device 21.

Now, assume that the carriage 13 has been started to move from a home position. The carriage 13 is moving on the basis of the block signal C, and moves for a space operation in a block having no firing signal (printing is not carried out). As described above, the transit speed of the carriage 13 through the block at that time is determined by the first control device 20 on the basis of the differentiation pulse signal B due to the transit through the firing signal slit 16. In a block having the fire signal (printing is carried out), the second control device 21 controls the dot position on the basis of the firing time signal D having a pulse interval which has been determined on the basis of the transit speed of the carriage 13 just before that time as described above, and drives the head 11 to carry out printing in accordance with the printing data previously set.

Next, when the carriage 13 is stopped in a block having no firing signal, the carriage 13 is stopped at the substantially central portion of the block as described above, so that vibrations of the carriage 13 never cause the second control device 21 to miss the printing position. This is because, when the carriage 13 is started to carry out printing again after stoppage, it is ensured that the firing timing signal D can be obtained from the head of the next block.

Further, even if the carriage 13 vibrates when it is stopped, the moving speed of the carriage 13 becomes constant in the succeeding block after the return operation, so that the vibration never influences the speed. That is, in return printing, the block signal is produced only after the carriage 13 has passed the length of vibrations of the carriage 13, and thereafter a printing command is produced. Accordingly, the displacement in printing dots in each block is extremely reduced, practically as well as theoretically.

Thus, the block signal c is used as a signal for a quantity of space dimension or for a stopping position, whereas the firing timing signal D is used as a signal for a dot printing position.

As described above, according to the present invention, the photo encoder can be used, so that the absolute position of the carriage in moving can be easily and accurately controlled, and correct printing can be carried out without causing a displacement in dots against a change in speed of the carriage or vibrations when the carriage is stopped.

What is claimed is:

1. A serial dot matrix printer for carrying out printing operations in accordance with a preset firing signal by shuttling a carriage having a printing head, said printer comprising:

motor means for driving said carriage;

slit encoder means for producing firing and block signals provided with firing signal slits each having a predetermined width and which are successively formed with a predetermined space therebetween, and provided with block signal slits each having a width smaller than said predetermined width of said firing signal slits and which are formed in every block composed of a plurality of said firing signal slits;

optical sensor means arranged to move along a length of said slit encoder means as said carriage moves for producing a signal at every one of said firing signal and block signal slits;

first control means having block detecting means and firing timing means, said block detecting means measuring a transit time between each of said firing signal and block signal slits in response to said signal from said optical sensor and detecting a block signal when the measured transit time is less than a predetermined value, said firing timing means producing a firing timing signal by dividing the transit time through each of said firing signal slits by a predetermined number every time a firing signal slit is measured; and second control means having carriage control means for controlling said motor means according to said detected block signals.

2. A serial dot matrix printer as claimed in claim 1, in which said carriage control means controls said carriage to stop in a block having no firing signal after passage of a preceding block having a firing signal.

3. A serial dot matrix printer as claimed in claim 2, in which said carriage control means controls said carriage to stop at the substantially central portion in said block.

4. A serial dot matrix printer as claimed in claim 1, in which said optical sensor means opposes said slit encoder.

5. A serial dot matrix printer as claimed in claim 1, in which said optical sensor means is provided with light emitting diode means and photo transistor means opposed to each other and interposing said slit encoder means therebetween.

6. A serial dot matrix printer as claimed in claim 1, in which the predetermined width of said firing signal slits is equal to the predetermined space therebetween.

7. A serial dot matrix printer as claimed in claim 6, in which the width of each of said block signal slits is about half the width of each of said firing signal slits.

* * * * *